United States Patent [19]

Tesch

[11] 4,364,674

[45] Dec. 21, 1982

[54] WATCH CASES WITH PUSHBUTTONS

[76] Inventor: Bernhard Tesch, Im Baumgarten 4, CH 6373, Ennetbuergen, Switzerland

[21] Appl. No.: 71,050

[22] Filed: Aug. 30, 1979

[30] Foreign Application Priority Data

Aug. 31, 1978 [DE] Fed. Rep. of Germany ..... 2837939

[51] Int. Cl.[3] ..... G04B 29/00

[52] U.S. Cl. ..... 368/319; 368/308

[58] Field of Search ..... 58/23 R, 50 R, 50 A, 58/85.5, 90 B; 200/DIG. 25, 5 R, 5 A, 5 B, 56 R, 61.76, 52 R, 159 A, 159 B, 159 R, 302, 340; 368/319–321, 308

[56] References Cited

U.S. PATENT DOCUMENTS

| | | | |
|---|---|---|---|
| 2,456,122 | 12/1948 | Guilden | 58/85.5 |
| 2,714,284 | 8/1955 | Gazda | 58/85.5 |
| 3,952,176 | 4/1976 | Holder et al. | 200/52 R |
| 4,007,347 | 2/1977 | Haber | 200/52 R |
| 4,031,341 | 6/1977 | Wuthrich et al. | 200/52 R |
| 4,122,664 | 10/1978 | Stampfli | 368/320 |

*Primary Examiner*—Bernard Roskoski
*Attorney, Agent, or Firm*—Diller, Ramik & Wight

[57] ABSTRACT

This disclosure relates to a watch case which includes a case body housing a movable element actuated by a slidably mounted pushbutton for effecting movement of the movable element through a rod connected to the pushbutton, the rod having a portion which transfers the sliding movement of the pushbutton to the movable element, and guide means in the form of grooves, bores or guide surfaces for guiding the movement of the rod relative to the case body during the movement of the rod under the influence of the sliding movement of the pushbutton.

38 Claims, 3 Drawing Figures

WATCH CASES WITH PUSHBUTTONS

This invention relates to watch cases which include one or more pushbuttons mounted for sliding movement in a wall of a case or case body within which is housed a watch movement including one or more movable elements which are adapted to be actuated by the operation of the one or more pushbuttons. Such pushbuttons are used in both mechanical and electronical watches to trigger manifold functions, such as the stop systems in stopwatches or the time display systems in electronic watches. Thus, the pushbuttons are depressed in the normal conventional manner to actuate a movable element which in turn is part of or in turn operates the stop system and/or the time display system of conventional watches.

In conventional watch cases of the type aforesaid, the one or more pushbuttons ordinarily project beyond the outer peripheral surface of the watch case and may be in the form of single arm levers pivotally supported at one end or slidably displaceable relative to the watch case body generally in directions radially thereto. Whether the pushbuttons utilize single arm levers or are simply slidably mounted relative to the watch case, a considerable amount of space is required to house such elements in order to properly seat not only the pushbuttons but seals and return springs associated therewith. The latter difficulties are further amplified when the pushbuttons are housed in recesses of the watch case so as to be mounted flush to the outer peripheral wall thereof, generally for ascetic reasons. In such cases, it is difficult, if not impossible, to provide reliable guidance for the movement of the pushbuttons, be they single arm levers or simply reciprocal or slidably mounted pushbuttons. In the case of sliding pushbuttons, unascetic bores or openings therefor should be avoided and for relatively large pushbuttons the same actuation pressure should be effective at all locations of the pushbutton, and this is difficult to achieve unless the size of the case and the wall thickness thereof is enlarged to an undesired degree. Such increase in size of the watch case and the wall thickness of the housing thereof is not only necessary to accommodate for sliding pushbuttons, but it is also generally necessary to provide reliable guidance for the sliding motion of the pushbuttons such that the sliding motion can be transferred accurately and reliably to the actuating or control elements of the watch movement.

In keeping with the foregoing, it is a primary object of the present invention to eliminate the disadvantages heretofore set forth of conventional pushbutton watch cases wherein the watch case or case body exceeds the external peripheral dimensions of the watch movement as little as possible, while nevertheless providing reliable guidance of the pushbuttons and associated rods along relatively long guidance paths such that the sliding motion of the pushbuttons is reliably transferred to elements of the watch movement operative to control the watch movement stop system, time display system, or the like.

In keeping with the foregoing, the present invention provides in association with sliding or reciprocal pushbuttons a push rod which functions as a guide component and which is in turn guided during its motion by guide means of the watch case or case body disposed a substantial distance away from the pushbutton to accurately guide the motion of the push rod and, thus, accurately translate the sliding motion of the pushbutton to the movable element of the watch movement.

In further accordance with this invention, the guide component or push rod may have a terminal end portion which slides relative to the guide means of the watch case body or alternatively may slide relative to a pair of circumferentially spaced guide bores of the watch case body or alternatively may be pivotally fixed to the watch case body to effect the guidance of the push rod upon the depression of the pushbutton and the sliding motion of the latter which controls the movement of the movable element of the watch movement.

Yet another object of this invention is to provide a novel watch case of the type set forth heretofore wherein the guide means for the push rod are remote from the associated push button and preferably are diametrically opposite thereto and are in the form of glide surfaces, guiding surfaces, grooves and/or bores of the watch case body.

In further accordance with this invention, the guide component or push rod may be partially rigid and partially elastic in its construction or may be totally elastic. In the case of the guide component or push rod being partially elastic, the guide means therefor may assume the form of a fixed pivot connecting a terminal end of the push rod to a bore of the watch case body.

In further accordance with this invention, the push rod may be guided by a suitable guide means in the form of a single longitudinal guide surface which is preferably so disposed that a tangent therethrough is parallel to the axis of sliding movement of the associated pushbutton.

In further accordance with this invention, the guide component or push rod may be housed and guided in the groove of the watch case which opens inwardly toward the watch movement with the groove being immediately adjacent an inner peripheral surface of the watch case, an outer peripheral surface of the watch case, or partially adjacent both inner and outer peripheral surfaces of the watch case to accommodate different portions of the push rod or guide component.

The push rod or guide component is generally of an arcuate configuration opening in a direction toward the watch movement, but a portion of the push rod may be bent radially outwardly such that the push rod has inner and outer arcuate portions guided in inner and outer guide grooves of the watch case body.

In further accordance with this invention, the push rod is preferably connected to the associated push button along its axis which is offset to the central or center axis of the push button and at a side thereof opposite to that of the associated guide means for the push rod.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
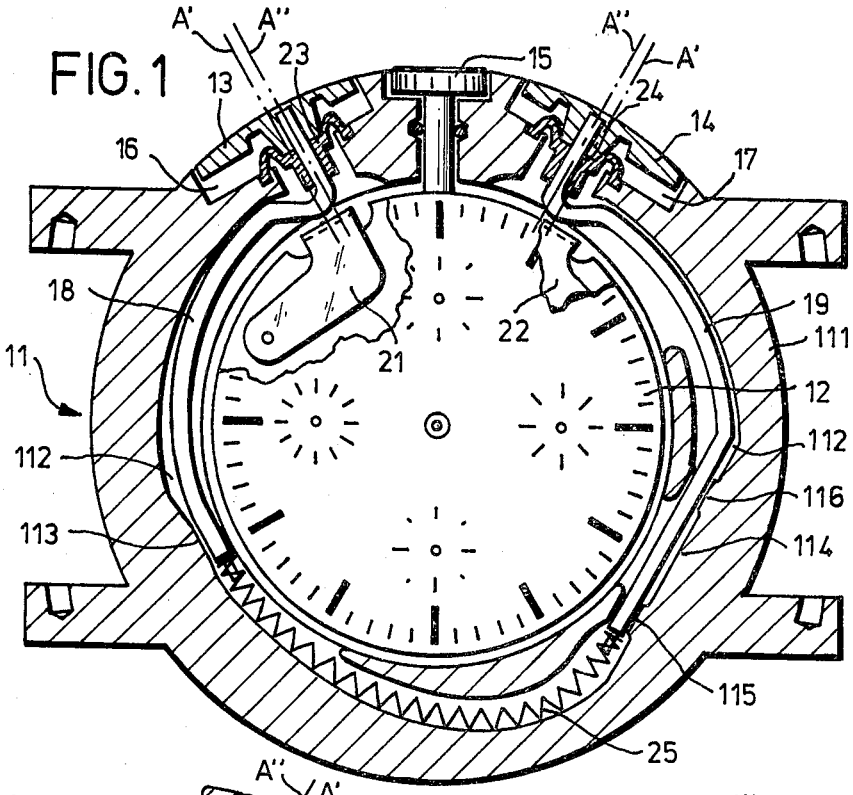
FIG. 1 is a cross-sectional view of a watch case having a pair of pushbuttons, and illustrates a push rod associated with each for operating a movable element of a watch movement with each push rod being guided during its movement by appropriate guide means of the watch case.

A novel watch case constructed in accordance with this invention is fully illustrated in FIG. 1 of the drawing and is generally designated by the reference numeral 11. The watch case 1 includes a case body (unnumbered) which hermetically encloses a watch movement 12 and includes two relatively large area pushbuttons 13 and 14 mounted for sliding movement on both sides of a crown 15 in a peripheral wall 111 of the case or case body in such a manner that the pushbuttons 13 and 14 in their "home" or rest position have their outer surfaces (unnumbered) flush with the peripheral outer surface (unnumbered) of the peripheral wall 111, as is readily apparent in FIG. 1.

The pushbuttons 13 and 14 are housed in bores 16 and 17, respectively of the peripheral wall 111 with the clearances (unnumbered) between the outer periphery (unnumbered) of the pushbuttons 13, 14 and the inner peripheral wall surfaces (unnumbered) of the bores 16, 17, respectively, serving to guide the sliding reciprocal motion of the pushbuttons 13, 14. In this manner, the pushbuttons 13, 14 are guided for sliding or reciprocal motion when pushed or depressed in a conventional manner.

The pushbuttons 13, 14 are rigidly connected to first terminal end portions (unnumbered) of respective push rods or guide components 18, 19 with the push rods 18, 19 being designed to actuate movable pivotally mounted elements 21, 22 of the watch movement 12. Each push rod 18, 19 is seated in a groove 112 formed on the inside periphery (unnumbered) of the case wall 111 and open in a direction inwardly toward the watch movement 12. The push rods 18,19 are guided by means 113, 114, respectively, formed by the case wall 111. The function of the guiding means 113, 114 is to guide the movement of the rods 18, 19 relative to the case wall 111 upon the inward depression of the pushbuttons 13, 14, respectively.

The guiding means 113 constitutes a glide or guide bearing surface which in part defines the groove 112 associated with the push rod 18 and is preferably disposed adjacent a free terminal end portion (unnumbered) of the push rod 18 at a point remote from the first terminal end portion (unnumbered) of the push rod 18 connected to the push button 13. A line tangent to the guide means 113 is generally parallel to the sliding axis of the pushbutton 13 which optimizes the transfer of the inward force of the pushbutton 13 through the push rod 18 to the movable element 21 in the area of the offset portion (unnumbered) of the push rod 18 adjacent the pushbutton 13. The guiding means 114 of the watch case 11 likewise includes a first end portion (unnumbered) fixed to the push button 14 at an opposite relatively straight second terminal end portion (unnumbered) guided by the guide means 114 which in this case is formed of a pair of spaced aligned bores 115, 116 which collectively define a generally longitudinal linear guide path thereby permitting reliable guidance of the push rod 19 upon the depression of the pushbutton 14.

Biasing means in the form of a spring 25 is appropriately housed in the casing wall 111 and acts against the second terminal end portions (unnumbered) of the push rods 18, 19 to urge the latter end portions away from each other and, thus, the pushbuttons 13, 14 to their flush positions, as is illustrated in FIG. 1.

Suitably elastic seals 23, 24 of a generally annular configuration are housed between the respective pushbuttons 13, 14 and the bores 16, 17, respectively, of the casing wall 111. The seals 23, 24 not only seal the interior of the case 11 from atmospheric contaminants but also serve in and of themselves as guide means for guiding the sliding motion of the pushbuttons 13, 14. Thus, in addition to the guidance offered by the seals 23, 24, the guiding means 113 and 115, 116 insure reliable guiding movement of the respective push rods 18, 19 such that upon depression of the pushbuttons 13, 14, the offset portions (unnumbered) of each adjacent the respective pushbuttons 13, 14 contact and move the movable elements 21, 22 which may, of course, operate suitable stop systems or time display systems of mechanical and/or electronic watches.

Figure 2:
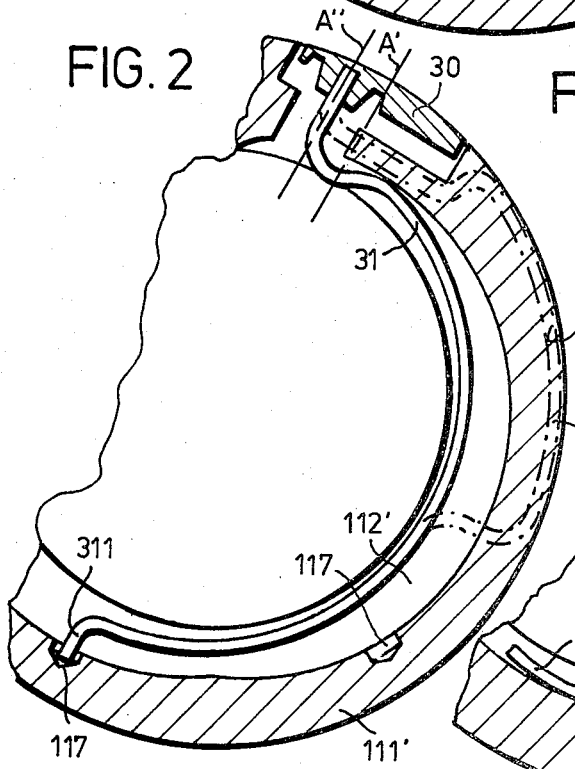
FIG. 2 is a fragmentary cross-sectional view similar to that shown in FIG. 1, and illustrates another embodiment of the invention in which a push rod has a terminal end fixed by a pivotal connection to a bore of the case body.

Referring now to the embodiment of the invention illustrated in FIG. 2, a similar push rod or guide component 31 is connected to a pushbutton 30 and the push rod 31 is preferably formed of elastic material over its entire length. In this case, a bent terminal end portion 311 of the push rod 31 is disposed generally diametrically opposite to the pushbutton 30 and is pivotally connected in a bore 117 of the case wall 111'. The push rod or guide component 31 is seated in a groove 112' on the inside periphery of the case 111'. A second bore 117 is formed in the case wall 111' at approximately the 5 o'clock position of FIG. 2 to accommodate a second push rod (not shown). As in the case of the embodiment of the invention illustrated in FIG. 1, if the pushbutton 30 is depressed, the push rod 31 moves by an outward bending action and is guided during such outward bending movement by the groove 112' which in effect functions as the guiding means for the push rod 31. Obviously, in order for the groove 112' to function as a guide upon the outward bending of the push rod 31, the size of the groove must correspond generally to the diameter or thickness of the push rod 31 so that the guidance afforded by the groove 112' exists substantially along the entire length of the push rod 31 from the area of the pushbutton 30 to the end portion 311. In this manner, the groove 112' functioning as the guiding means effectively guides the push rod 31 in a reliable fashion due to the virtually total length of guidance afforded the push rod 31 by the arcuate length of the groove 112'.

The embodiment of the invention illustrated in FIG. 2 may be varied by constructing the push rod or guide component 31 from relatively rigid material and placing a compression spring between the bore 117 and the end 311 of the push rod 31. With this construction, upon the depression of the pushbutton 30, the push rod 31 does not move through a bending action, but instead bodily moves within and is guided by the groove 112' during which motion the compression spring between the end portion 311 and the bore 117 is compressed to accommodate for the bodily movement of the push rod 31. During this movement, as well as the bending movement of the elastic push rod 31 described earlier, the offset (unnumbered) portion of the push rod 31 adjacent the pushbutton 30 operates a movable element (not shown in FIG. 2) corresponding to the movable element 22 of FIG. 1. In the case of the elastic construction of the push rods 31, the natural or inherent rebound characteristics thereof return the pushbutton 30 to its flush position (FIG. 2), while in the case of the rigid construction of the push rod 31, the spring between the bore 117 and the end portion 311 moves the rigid push rod 31 toward and to the position shown in FIG. 2, again bringing the pushbutton 30 to its flush position.

In another variation of the invention shown in FIG. 2, a portion 112'' of the groove 112' may be offset radially outwardly toward an outer periphery of the casing wall 111' to accommodate a similarly radially outwardly offset portion 31' of the push rod. Thus, the offset portion 31' would be guided by a circumferentially outboard portion of the groove or guide means 112'', while an inboardmost portion of the same push rod would be guided by a more inboard portion of the groove 112'.

Figure 3:
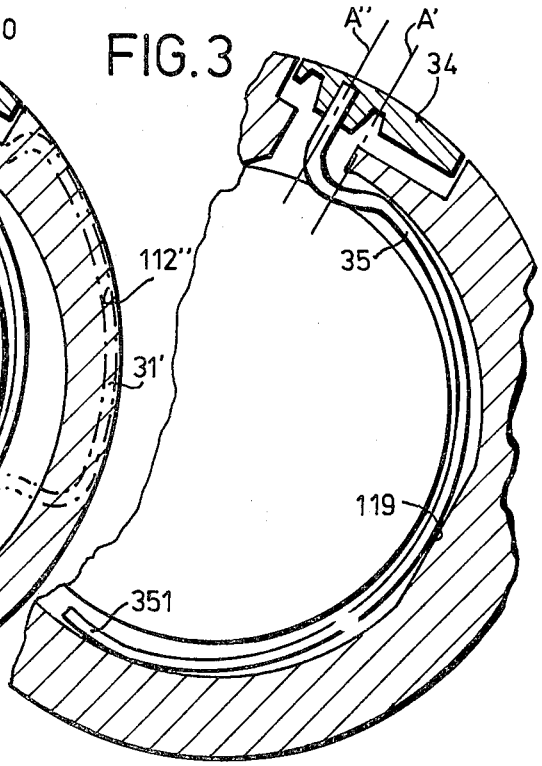
FIG. 3 is a cross-sectional view of another embodiment of the invention, and illustrates a push rod which is relatively rigid adjacent the pushbutton and relatively elastic remote therefrom with guide means of the watch case being disposed between the rigid and elastic portions.

Reference is now made to FIG. 3 of the drawings in which a push rod or guide component 35 is connected at a first end portion (unnumbered) to a pushbutton 34 with the push rod 35 again being seated within a groove (unnumbered). The push rod 35 may be made of elastic material over its entire length, for instance it may consist of a spring wire. In the present case, the push rod or guide component 35 is guided by guiding means 119 forming a bottom or bight portion of the unnumbered groove which opens toward the watch movement (unnumbered), and the guiding means 119 corresponds generally to the guiding means 113 of FIG. 1. However, in the embodiment of the invention shown in FIG. 3, a terminal end portion 351 of the push rod 35 projects beyond the guiding means 119 and rests against a bottom or bight of the groove (unnumbered) at a point generally diametrically opposite to the pushbutton 34. In this manner, due to the position of the terminal end portion 351 and the construction of the push rod 35 from elastic or similar springlike material, the end portion 351 serves as a return spring to urge the pushbutton 34 back to its flush or "home" position.

As a further variation of the embodiment of the invention shown in FIG. 3, the push rod 35 may be partly rigid and partly elastic, namely, being rigid in that portion between the pushbutton 34 and the guiding means 119 and elastic in that part projecting beyond the guiding means 119. In the latter case, the guiding means 119 is preferably of the same design as the guiding means 114 of FIG. 1 provided that the push rod 35 can be provided with a corresponding linear or straight line terminal end portion, again as is shown in FIG. 1.

In each of the embodiments of the invention illustrated in FIGS. 1 through 3, it is to be noted that each of the pushbuttons has a center or axis which in FIG. 1 is designated by the reference character A' associated with the pushbutton 13. Likewise, each button has a sliding axis which again in FIG. 1 is designated by the reference character A''. The center axis A' of the button 13 is offset from the axis of sliding A'' of the button 13 and the offsetting of the axis A' is in a direction toward the free terminal end portion (unnumbered) of the push rod 18 remote from the button 13. Stated otherwise, the center axis A' of the button 13 is between the axis of sliding A'' of the button 13 and the remote terminal end portion of the push rod 18 adjacent the guiding means 113. Due to this relationship of the axes A' and A'', the inward sliding motion of the pushbutton 13 is efficiently and effectively transferred to move the movable element 21, and like efficient operation is effected by similar axes orientation of the pushbuttons 14 and 34 relative to the sliding axes thereof, as is indicated by like reference characters A' and A'' applied thereto.

Although only a preferred embodiment of the invention has been specifically illustrated and described herein, it is to be understood that minor variations may be made in the apparatus without departing from the spirit and scope of the invention, as defined in the appended claims.

I claim:

1. A watch case comprising a case body housing a pushbutton mounted for movement relative to the case body, said case body having means for defining an interior chamber adapted to receive therein a watch movement, a rod rigidly connected to said pushbutton, said rod having a medial portion movable in a bore of said case body, said bore defining a radial direction perpendicular to the axis of the bore and having an innermost terminal end portion opening into said interior chamber said rod having a portion extending beyond the innermost terminal end portion of said bore in said radial direction, and means within said interior chamber defined by said case body spaced remote from said pushbutton and spaced outwardly in said radial direction from said bore. innermost terminal end portion for confiningly guiding the movement of said rod relative to said case body during the movement of the rod under the influence of the movement of the pushbutton.

2. The watch case as defined in claim 1 including means for guiding the movement of said pushbutton relative to said case body.

3. The watch case as defined in claim 1 wherein said guiding means are a pair of guide surfaces spaced from each other along which said rod can move.

4. The watch case as defined in claim 1 wherein said guiding means are a pair of guide surfaces spaced from each other along which said rod can move, one of said guide surfaces being adjacent said pushbutton, and another of said guide surfaces being remote therefrom.

5. The watch case as defined in claim 1 wherein said case body interior chamber includes an interior circumferential surface, and said rod includes a terminal end portion disposed diametrically opposite of said pushbutton.

6. The watch case as defined in claim 1 wherein at least a portion of said rod is elastic.

7. The watch case as defined in claim 1 wherein at least a portion of said rod is elastic, and said push rod includes a terminal end portion pivotally connected to said case body at a point diametrically opposite of said pushbutton.

8. The watch case as defined in claim 1 wherein said pushbutton has an axis along which said pushbutton slides, and said guiding means is located at a point of the watch case at which a tangent line thereat is parallel to said pushbutton axis.

9. The watch case as defined in claim 1 wherein said guiding means is a groove of said case body receiving said rod.

10. The watch case as defined in claim 1 wherein said guiding means is a groove interiorly of said case body receiving said rod.

11. The watch case as defined in claim 1 wherein said guiding means is a groove interiorly of said case body receiving said rod, and said groove includes at least two groove portions located on different circumferences of said case body.

12. The watch case as defined in claim 1 wherein said rod includes a relatively rigid portion adjacent said pushbutton and an elastic terminal end portion remote from said pushbutton.

13. The watch case as defined in claim 1 wherein said pushbutton has an axis, said pushbutton and rod having an axis of connection, said pushbutton axis being offset from the axis of connection between said pushbutton and said rod, and the axis of connection is disposed between the pushbutton axis and said guiding means.

14. The watch case as defined in claim 1 wherein said rod is of a generally arcuate configuration and includes a relatively straight terminal end portion, and said guiding means includes at least one bore slidably receiving said relatively straight terminal end portion.

15. The watch case as defined in claim 1 wherein said rod includes first and second terminal end portions, said first end portion being rigidly fixed to said pushbutton, said second terminal end portion being guided by said guiding means, and said medial portion of said rod being located between said first and second terminal end portions and being effective to transfer the movement of said pushbutton to a movable element within said case body.

16. The watch case as defined in claim 1 wherein said rod includes first and second terminal end portions and another rod portion therebetween, said first end portion being rigidly fixed to said pushbutton, said second terminal end portion being pivotally connected to said case body, and said another rod portion being effective to transfer the movement of said pushbutton to a movable element within said case body.

17. The watch case as defined in claim 1 wherein said case body interior chamber includes an interior circumferential surface, said rod includes first and second terminal end portions, said first end portion being rigidly fixed to said pushbutton, said second terminal end portion being disposed diametrically opposite to said first end portion, and said first and second end portions being respectively rigid and elastic.

18. The watch case as defined in claim 1 wherein said case body interior chamber includes an interior circumferential surface, said rod includes first and second terminal end portions, said first end portion being rigidly fixed to said pushbutton, said second terminal end portion being disposed diametrically opposite to said first end portion, said first and second end portion being respectively rigid and elastic, and said guiding means being disposed medially of said first and second terminal end portions.

19. The watch case as defined in claim 1 including first and second movable elements, a second pushbutton mounted for movement relative to the case body, means for effecting movement of said first and second movable elements upon movement of said first and second pushbuttons, said movement effecting means including said first rod and second rod rigidly connected to said second pushbutton, said first and second rods each having a portion which transfers the sliding movement of said respective first and second pushbuttons to said first and second movable elements to move the same, and means defined by said case body spaced remote from said second pushbutton for confiningly guiding the movement of said second rod relative to said case body during the movement of the second rod under the influence of the movement of the second pushbutton.

20. The watch case as defined in claim 19 including biasing means between said rods for normally urging said rods in a direction urging said pushbuttons in a direction outwardly of said case body.

21. The watch case as defined in claim 1 wherein said rod is defined by first and second portions disposed transverse to each other, said rod being of an integral, one-piece homogeneous construction, and said first portion being rigidly fixed to said pushbutton.

22. The watch case as defined in claim 1 wherein said pushbutton is mounted for sliding movement relative to said case body.

23. The watch case as defined in claim 1 wherein said rod is defined by first and second portions disposed transverse to each other, said rod being of integral, one-piece homogeneous construction, said first portion being rigidly fixed to said pushbutton, and said pushbutton is mounted for sliding movement relative to said case body.

24. The watch case as defined in claim 1 including a movable element housed within said case body, said pushbutton being mounted for sliding movement relative to said case body, means for effecting movement of said movable element upon sliding movement of said pushbutton, and said movement effecting means including a portion of said rod which transfers the sliding movement of said pushbutton to said movable element to move the latter.

25. The watch case as defined in claim 24, wherein said rod includes first and second terminal end portions, said first end portion being rigidly fixed to said pushbutton, said second terminal end portion being guided by said guiding means, and the portion of said rod which transfers the movement of said pushbutton to said movable element being located between said first and second terminal end portions.

26. The watch case as defined in claim 24, wherein said rod includes first and second terminal end portions, said first end portion being rigidly fixed to said pushbutton, said second terminal end portion being pivotally connected to said case body, and said rod portion which transfers the movement of said pushbutton to said movable element being located between said first and second terminal end portions.

27. The watch case as defined in claim 24 wherein said case body interior chamber includes an interior circumferential surface, said rod includes first and second terminal end portions, said first end portion being rigidly fixed to said pushbutton, said second terminal end portion being disposed diametrically opposite to said first end portion, and said first and second end portions being respectively rigid and elastic.

28. The watch case as defined in claim 24 wherein said case body interior chamber includes an interior circumferential surface, said rod includes first and second terminal end portions, said first end portion being rigidly fixed to said pushbutton, said second terminal end portion being disposed diametrically opposite to said first end portion, said first and second end portion being respectively rigid and elastic, and said guiding means being disposed medially of said first and second terminal end portions.

29. The watch case as defined in claim 1 wherein said rod includes first and second end portions and said medial portion therebetween, said first end portion being connected to said pushbutton, said first end portion and medial portion being disposed at least partially in transverse relationship to each other, said case body having an interior chamber adapted to receive a watch movement therein, said interior chamber being at least in part defined by an interior peripheral surface, and said another portion being disposed in adjacent generally side-by-side relationship along said interior peripheral surface.

30. The watch case as defined in claim 29 wherein said interior peripheral surface is cylindrical, and said second end portion slidably contacts said interior peripheral surface diametrically opposite to said pushbutton.

31. The watch case as defined in claim 29 wherein said interior peripheral surface is cylindrical, and means are provided for pivotally connecting said second end portion contiguous said interior peripheral surface diametrically opposite to said pushbutton.

32. The watch case as defined in claim 29 including spring means acting against said second end portion for normally biasingly urging said second end portion in a direction toward said pushbutton.

33. The watch case as defined in claim 29 wherein said guiding means are disposed at said interior peripheral surface.

34. The watch case as defined in claim 33 wherein said interior peripheral surface is cylindrical, and said second end portion slidably contacts said interior peripheral surface diametrically opposite to said pushbutton.

35. The watch case as defined in claim 33 wherein said interior peripheral surface is cylindrical, and means are provided for pivotally connecting said second end portion contiguous said interior peripheral surface diametrically opposite to said pushbutton.

36. The watch case as defined in claim 33 including spring means acting against said second end portion for normally biasingly urging said second end portion in a direction toward said pushbutton.

37. The watch case as defined in claim 1 wherein said rod further includes first and second terminal end portions at opposite sides of said medial portion, a bore in said case body, said medial portion being mounted for reciprocal sliding movement in said bore, said first terminal end portion constituting the rigid connection of said rod to said pushbutton, said case body interior chamber including an interior peripheral continuous surface, and said second terminal end portion being guided by said confiningly guiding means remote from said bore.

38. The watch case as defined in claim 37 wherein said interior peripheral continuous surface is generally circumferential and said confiningly guiding means is disposed generally diametrically opposite from said bore and said pushbutton.

* * * * *